US009940886B2

(12) United States Patent
Lee et al.

(10) Patent No.: US 9,940,886 B2
(45) Date of Patent: Apr. 10, 2018

(54) DISPLAY DEVICE WHICH PREVENTS OCCURRENCE OF FLICKER

(71) Applicant: Samsung Electronics Co., Ltd., Suwon-si, Gyeonggi-do (KR)

(72) Inventors: Hong-kook Lee, Seoul (KR); Dong-sub Kim, Suwon-si (KR); Hyun-chang Shin, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/511,755

(22) Filed: Oct. 10, 2014

(65) Prior Publication Data

US 2015/0103104 A1 Apr. 16, 2015

(30) Foreign Application Priority Data

Oct. 10, 2013 (KR) ..... 10-2013-0120866

(51) Int. Cl.
*G09G 3/36* (2006.01)

(52) U.S. Cl.
CPC ... *G09G 3/3648* (2013.01); *G09G 2320/0247* (2013.01); *G09G 2320/0626* (2013.01); *G09G 2320/0673* (2013.01); *G09G 2320/103* (2013.01); *G09G 2340/0435* (2013.01)

(58) Field of Classification Search
None
See application file for complete search history.

(56) References Cited

U.S. PATENT DOCUMENTS

| | | | | |
|---|---|---|---|---|
| 6,359,607 | B1 * | 3/2002 | Yanagi | G09G 3/3648 345/204 |
| 8,188,952 | B1 | 5/2012 | Orlando et al. | |
| 2005/0062704 | A1 | 3/2005 | Whittington et al. | |
| 2006/0033445 | A1 | 2/2006 | Kim et al. | |
| 2006/0038837 | A1 * | 2/2006 | Hong | G09G 3/3648 345/691 |
| 2006/0256051 | A1 * | 11/2006 | Lee | G09G 3/2011 345/87 |

(Continued)

FOREIGN PATENT DOCUMENTS

| | | | |
|---|---|---|---|
| EP | 2 557 560 | A2 | 2/2013 |
| JP | 2009-193063 | A | 8/2009 |
| KR | 10-2004-0071677 | A | 8/2004 |

OTHER PUBLICATIONS

Ito et al.; Application of amorphous oxide TFT to electrophoretic display; ScienceDirect; Journal of Non-Crystalline Solids; Feb. 15, 2008; Japan.

(Continued)

*Primary Examiner* — David D Davis
(74) *Attorney, Agent, or Firm* — Jefferson IP Law, LLP

(57) ABSTRACT

A display device which prevents or minimizes the occurrence of flicker is provided. The display device includes a display panel having pixels, with data lines and gate lines that are respectively connected with the pixels. A display driving circuit is configured to vary a frame frequency of the display panel according to an operation mode, to select a gamma curve corresponding to the frame frequency. The selected gamma curve is one among gamma curves that are set so as to correspond to different frame frequencies. The display panel is driven based on the selected gamma curve.

11 Claims, 12 Drawing Sheets

(56) References Cited

U.S. PATENT DOCUMENTS

| | | | | |
|---|---|---|---|---|
| 2008/0062155 | A1* | 3/2008 | Wang | G09G 3/3648 345/204 |
| 2008/0218463 | A1* | 9/2008 | Lee | G09G 3/3696 345/89 |
| 2009/0058763 | A1 | 3/2009 | Doi et al. | |
| 2009/0179833 | A1 | 7/2009 | Honda | |
| 2010/0033514 | A1 | 2/2010 | Park et al. | |
| 2010/0134473 | A1 | 6/2010 | Matsuda et al. | |
| 2013/0249969 | A1* | 9/2013 | Jeon | G09G 5/10 345/691 |

OTHER PUBLICATIONS

Jang et al.; Reliability of Oxide TFT for Display Application; 20th IEEE International Symposium on the Physical and Fallure Analysis of Integrated Circuits (IPFA); Jul. 15, 2013; Seoul, Korea.

* cited by examiner

DISPLAY DEVICE WHICH PREVENTS OCCURRENCE OF FLICKER

CROSS-REFERENCE TO RELATED APPLICATION(S)

This application claims the benefit under 35 U.S.C. § 119(a) of Korean patent application filed on Oct. 10, 2013 in the Korean Intellectual Property Office and assigned Serial number 10-2013-0120866, the entire disclosure of which is hereby incorporated by reference.

TECHNICAL FIELD

The present disclosure relates to a display driving circuit, a display device, and a portable terminal including the display driving circuit and the display device. More particularly, the present disclosure relates to a display driving circuit, a display device, and a portable terminal including the display driving circuit and the display device that may prevent the occurrence of flicker.

BACKGROUND

Recently, smartphones or tablet personal computers (PCs) that include an ultra-definition display module are being released. In this regard, a display driving circuit processes more data, and thus the amount of current used by the display driving circuit continues to increase. In order to increase battery use time, an internal circuit of a portable electronic device such as a smartphone or a tablet PC may operate with low power. Accordingly, there is a demand for a display device that operates with a lower power and produces a high-quality image.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a display driving circuit, a display device, and a portable terminal including the display driving circuit and the display device that may prevent the occurrence of flicker although they operate at a lower frequency.

Additional aspects will be set forth in part in the description which follows and, in part, will be apparent from the description, or may be learned by practice of the presented embodiments.

In accordance with an aspect of the present disclosure, a display device is provided. The display device includes a display device including a plurality of pixels, a plurality of data lines and plurality of gate lines that are respectively connected with the plurality of pixels, and a display driving circuit configured to vary a frame frequency of the display panel according to an operation mode, to select a gamma curve corresponding to the frame frequency, wherein the selected gamma curve is one among a plurality of gamma curves that are set so as to correspond to different frame frequencies, and to drive the display panel based on the selected gamma curve.

In accordance with another aspect of the present disclosure, the display driving circuit may be configured to store a first gamma selection signal and a second gamma selection signal that correspond to different gamma curves, respectively, and to select one of the first gamma selection signal and the second gamma selection signal as a gamma control signal, according to the frame frequency.

In accordance with another aspect of the present disclosure, the plurality of gamma curves may include a first gamma curve that corresponds to a first frame frequency and a second gamma curve that corresponds to a second frame frequency that is lower than the first frame frequency, and grayscale voltages of the second gamma curve may be lower than grayscale voltages of the first gamma curve.

In accordance with another aspect of the present disclosure, during a moving image mode, the display driving circuit may display a moving image received from an external source on the display panel, based on a first frame frequency, and during a still image mode, the display driving circuit may display a still image stored in an internal frame memory on the display panel, based on a second frame frequency that is lower than the first frame frequency.

In accordance with another aspect of the present disclosure, during the moving image mode, the display driving circuit may generate a display synchronization signal having the first frame frequency, based on a control signal and an external clock signal that are provided from the external source, and during the still image mode, the display driving circuit may generate a display synchronization signal having the second frame frequency, based on an internal clock signal.

In accordance with another aspect of the present disclosure, the display driving circuit may be configured to adjust a falling slew rate of a gate signal that is provided to each of the plurality of gate lines, according to the frame frequency.

In accordance with another aspect of the present disclosure, the display driving circuit may be configured to generate the gate signal by using a gate-on voltage and a gate-off voltage, and when the frame frequency is equal to or lower than a reference value, the display driving circuit may periodically drop a level of the gate-on voltage from a first voltage level to a second voltage level that is lower than the first voltage level, during a predetermined time period in response to a kickback signal.

In accordance with another aspect of the present disclosure, the display device may further include a host controller configured to provide image data and an operation mode signal for indicating the operation mode to the display driving circuit.

In accordance with another aspect of the present disclosure, when the image data is a moving image, the host controller may provide a first operation mode signal indicating a moving image mode to the display driving circuit, and when the image data is a still image, the host controller may provide a second operation mode signal indicating a still image mode to the display driving circuit.

In accordance with another aspect of the present disclosure, during a power-on or initial setting of the display device, the host controller may provide a plurality of gamma selection signals that correspond to the plurality of gamma curves, respectively, to the display driving circuit.

In accordance with another aspect of the present disclosure, the display panel may include an oxide thin film transistor substrate in which each of the plurality of pixels includes an oxide thin film transistor.

In accordance with another aspect of the present disclosure, a portable terminal is provided. The portable terminal includes a display panel comprising a plurality of pixels, a display driving circuit configured to vary a frame frequency of the display panel in response to a received operation mode signal, to select a gamma curve among a plurality of gamma curves which corresponds to the frame frequency, and to drive the display panel based on the selected gamma curve, and an application processor configured to provide image data and the operation mode signal to the display driving circuit.

In accordance with another aspect of the present disclosure, the application processor may be configured to provide a first operation mode signal indicating a moving image mode, or a second operation mode signal indicating a still image mode to the display driving circuit, according to whether the image data is a moving image or a still image.

In accordance with another aspect of the present disclosure, when the display driving circuit receives the first operation mode signal, the display driving circuit may drive the display panel based on a first frame frequency, and when the display driving circuit receives the second operation mode signal, the display driving circuit may drive the display panel based on a second frame frequency that is lower than the first frame frequency.

In accordance with another aspect of the present disclosure, the display driving circuit may be further configured to select one of a first gamma selection signal corresponding to the first frame frequency and a second gamma selection signal corresponding to the second frame frequency, as a gamma control signal, according to the operation mode signal.

In accordance with another aspect of the present disclosure, when the display driving circuit receives the first operation mode signal, the display driving circuit may set a kickback signal for decreasing a falling slew rate of a gate signal that is provided to each of a plurality of gate lines connected with the plurality of pixels.

In accordance with another aspect of the present disclosure, a display driving circuit is provided. The display driving circuit includes a timing controller configured to vary a frame frequency of a display panel, according to an operation mode, and to output one of a first gamma selection signal and a second gamma selection signal, as a gamma control signal. The first gamma selection signal and the second gamma selection signal are set so as to correspond to different frame frequencies, and a data driver is configured to generate a plurality of grayscale voltages, in response to the gamma control signal, and the display panel circuit outputs, to the display panel, a grayscale voltage, from among the plurality of grayscale voltages, which corresponds to pixel data.

The timing controller may include a first storage unit configured to store the first gamma selection signal corresponding to a first frame frequency, and a second storage unit configured to store the second gamma selection signal corresponding to a second frame frequency that is lower than the first frame frequency.

In accordance with another aspect of the present disclosure, when the operation mode indicates a moving image mode, the timing controller may generate a screen synchronization signal having a first frame frequency, based on a control signal and an external clock signal that are received from an external source, and when the operation mode indicates a still image mode, the timing controller may generate a screen synchronization signal having a second frame frequency that is lower than the first frame frequency, based on an internal clock signal.

In accordance with another aspect of the present disclosure, the display driving circuit may further include a voltage generator configured to generate a gate-on voltage having a first voltage level which is provided to a plurality of gate lines of the display panel and that periodically drops a level of the gate-on voltage from the first voltage level to a second voltage level that is lower than the first voltage level, during a predetermined time period in response to a kickback signal.

In accordance with another aspect of the present disclosure, a method for controlling display of a display panel is provided. The method includes receiving a media content from an external source, determining an operation mode in which to operate the display panel according to a type of the media content received from the external source, varying a frame frequency of the display panel according to an operation mode, selecting a gamma curve corresponding to the frame frequency, wherein the selected gamma curve is one among a plurality of gamma curves that are set so as to correspond to different frame frequencies, and driving the display panel based on the selected gamma curve.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
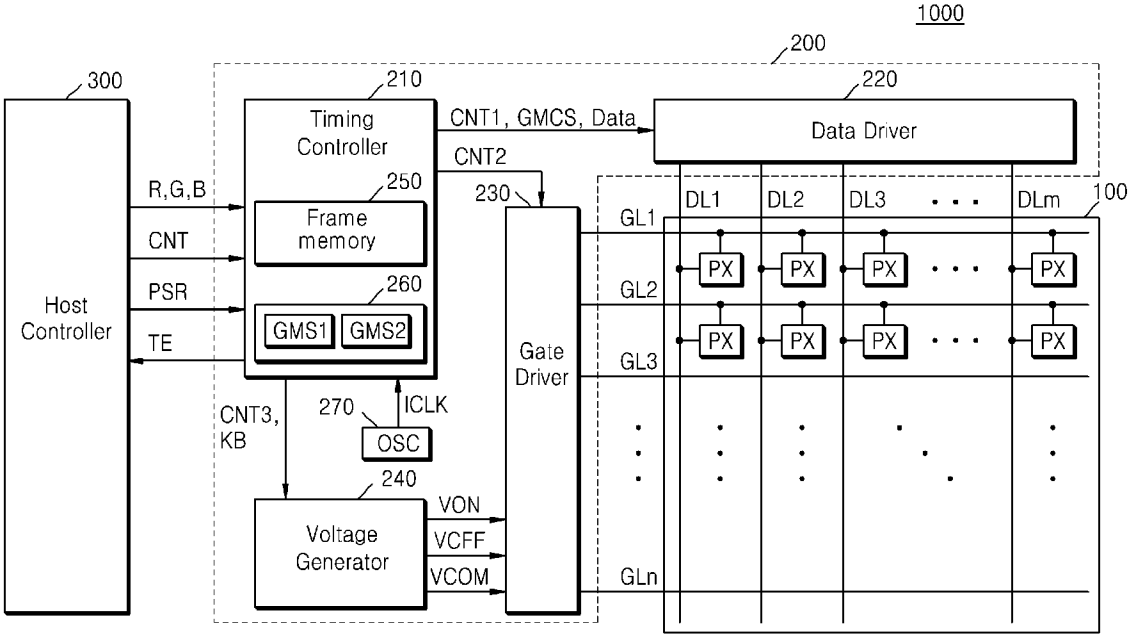
FIG. 1 is a block diagram of a display device according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Furthermore, all examples and conditional language recited herein are to be construed as being without limitation to such specifically recited examples and conditions. Throughout the specification, a singular form may include plural forms, unless there is a particular description contrary thereto. In addition, terms such as "comprise" or "comprising" are used to specify existence of a recited form, a number, a process, an operation, a component, and/or groups thereof, not excluding the existence of one or more other recited forms, one or more other numbers, one or more other processes, one or more other operations, one or more other components and/or groups thereof. Unless expressly described otherwise, all terms including descriptive or technical terms which are used herein should be construed as having meanings that are obvious to one of ordinary skill in the art. In addition, terms that are defined in a general dictionary and that are used in the following description should be construed as having meanings that are equivalent to meanings used in the related description, and unless expressly described otherwise herein, the terms should not be construed as being ideal or excessively formal.

As used herein, the term "and/or" includes any and all combinations of one or more of the associated listed items. Expressions such as "at least one of", when preceding a list of elements, modify the entire list of elements and do not modify the individual elements of the list.

According to various embodiments of the present disclosure, an electronic device may include communication functionality. For example, an electronic device may be a smart phone, a tablet personal computer (PC), a mobile phone, a video phone, an e-book reader, a desktop PC, a laptop PC, a netbook PC, a personal digital assistant (PDA), a portable multimedia player (PMP), an mp3 player, a mobile medical device, a camera, a wearable device (e.g., a head-mounted device (HMD), electronic clothes, electronic braces, an electronic necklace, an electronic appcessory, an electronic tattoo, or a smart watch), and/or the like.

According to various embodiments of the present disclosure, an electronic device may be a smart home appliance with communication functionality. A smart home appliance may be, for example, a television, a digital video disk (DVD) player, an audio, a refrigerator, an air conditioner, a vacuum cleaner, an oven, a microwave oven, a washer, a dryer, an air purifier, a set-top box, a TV box (e.g., Samsung HomeSync™, Apple TV™, or Google TV™), a gaming console, an electronic dictionary, an electronic key, a camcorder, an electronic picture frame, and/or the like.

According to various embodiments of the present disclosure, an electronic device may be a medical device (e.g., magnetic resonance angiography (MRA) device, a magnetic resonance imaging (MRI) device, computed tomography (CT) device, an imaging device, or an ultrasonic device), a navigation device, a global positioning system (GPS) receiver, an event data recorder (EDR), a flight data recorder (FDR), an automotive infotainment device, a naval electronic device (e.g., naval navigation device, gyroscope, or compass), an avionic electronic device, a security device, an industrial or consumer robot, and/or the like.

According to various embodiments of the present disclosure, an electronic device may be furniture, part of a building/structure, an electronic board, electronic signature receiving device, a projector, various measuring devices (e.g., water, electricity, gas or electro-magnetic wave measuring devices), and/or the like that include communication functionality.

According to various embodiments of the present disclosure, an electronic device may be any combination of the foregoing devices. In addition, it will be apparent to one having ordinary skill in the art that an electronic device according to various embodiments of the present disclosure is not limited to the foregoing devices.

According to various embodiments of the present disclosure, a display device or display module may be integrated with or otherwise included in an electronic device.

Figure 2:
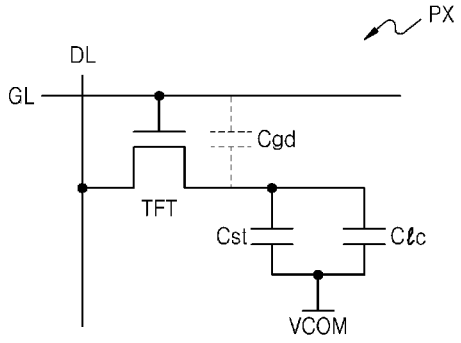
FIG. 2 is a circuit diagram of a pixel such as, for example, one of the pixels illustrated in FIG. 1 according to an embodiment of the present disclosure.

FIG. 1 is a block diagram of a display device according to an embodiment of the present disclosure. FIG. 2 is a circuit diagram of a pixel such as, for example, one of the pixels illustrated in FIG. 1 according to an embodiment of the present disclosure.

According to various embodiments of the present disclosure, the display device 1000 may correspond to a display module, or a portable terminal or a portable communication electronic device in which the display module is mounted so as to perform an image display function. For example, the display device 1000 may include laptop computer, a mobile phone, a smartphone, a tablet PC, a PDA, an enterprise digital assistant (EDA), a digital still camera, a digital video camera, a PMP, a personal navigation device, a portable navigation device, a handheld game console, a mobile internet device (MID), or an e-Book.

Referring to FIG. 1, the display device 1000 includes a display panel 100 that displays an image and a display driving circuit 200 that drives the display panel 100 based on image data R, G, B, a control signal CNT, a mode selection signal panel self refresh (PSR), and/or the like. The display device 1000 may further include a host controller 300 that provides the image data R, G, B, the control signal CNT, and the mode selection signal PSR to the display driving circuit 200.

The display panel 100 displays the image data R, G, B, based on a frame frequency. The display panel 100 may be formed as a liquid crystal display (LCD), a light-emitting diode (LED) display, an organic LED (OLED) display, an active-matrix OLED (AMOLED) display, a flexible display, or another type of flat panel display. For convenience of description, hereinafter, it is assumed that the display panel 100 is an LCD.

The display panel 100 includes a plurality of gate lines GL1 through GLn that transmits a scan signal in a row direction; a plurality of data lines DL1 through DLm that cross the gate lines GL1 through GLn and that transmit a grayscale voltage that corresponds to pixel data Data in a column direction; and a plurality of pixels PX that are arrayed in regions at which the gate lines GL1 through GLn cross the data lines DL1 through DLm.

Referring to FIG. 2, if the display panel 100 is formed as an LCD panel including a thin film transistor TFT, then each of the pixels PX includes a thin film transistor TFT. The thin film transistor TFT includes a gate electrode and a source electrode that are respectively connected with a gate line GL and a data line DL. The thin film transistor TFT may also include a drain electrode that is connected to a liquid crystal capacitor Clc and a storage capacitor Cst. In the structure of the pixel PX, when the gate line GL is selected, the thin film transistor TFT that is connected with the gate line GL is turned on and a data signal, including pixel information (e.g., a grayscale voltage), is applied to the data line DL. The grayscale voltage is applied to the liquid crystal capacitor Clc and the storage capacitor Cst via the thin film transistor TFT of the pixel PX, and the liquid crystal capacitor Clc and the storage capacitor Cst are driven so that a display operation is performed.

As illustrated in FIG. 2, a parasitic capacitor Cgd may be formed between the gate electrode and the source electrode of the thin film transistor TFT, such that a kickback voltage may be generated. The kickback voltage may cause flicker and an afterimage that deteriorate image quality, such that there is a demand for a method of decreasing the kickback voltage and the flicker. According to various embodiments of the present disclosure, the display device 1000 may decrease the kickback voltage and may prevent the occurrence of flicker. This will be described in detail below.

The display driving circuit 200 may include a timing controller 210, a data driver 220, a gate driver 230, and a voltage generator 240. In addition, the display driving circuit 200 may further include a clock generating circuit 270. The display driving circuit 200 may be formed as one semiconductor chip or a plurality of semiconductor chips.

The timing controller 210 may receive the image data R, G, B, the mode selection signal PSR, and the control signal CNT from an external source (e.g., the host controller 300), and may generate signals (e.g., first through third control signals CNT1, CNT2, and CNT3, a gamma control signal GMCS, and pixel data Data) that are required for operating the data driver 220, the gate driver 230, and the voltage generator 240. The first through third control signals CNT1, CNT2, and CNT3 may include a plurality of timing signals such as a vertical synchronization signal, a horizontal synchronization signal, a latch signal, a clock signal, an output enable signal, and/or the like.

The timing controller 210 may include a frame memory 250, so that the timing controller 210 may temporarily store the externally received image data R, G, B in the frame memory 250 and may output data, which is stored in the frame memory 250, to the data driver 220 in response to a timing signal.

The timing controller 210 may include a serial interface (not shown) so as to communicate with the host controller 300. For example, the serial interface may be one of the Mobile Industry Processor Interface (MIPI®), the Mobile Display Digital Interface (MDDI), the DisplayPort, the Inter integrated circuit (I2C) interface, the Embedded DisplayPort (eDP), and/or the like.

The data driver 220 drives the data lines DL1 through DLm of the display panel 100, in response to the first control signal CNT1 and the gamma control signal GMCS. The data driver 220 may generate a plurality of grayscale voltages in response to the gamma control signal GMCS that sets a gamma value and may output a grayscale voltage corresponding to the pixel data Data to the data lines DL1 through DLm of the display panel 100. The data driver 220 may be formed as one semiconductor chip or a plurality of semiconductor chips.

The gate driver 230 sequentially scans the data lines DL1 through DLm of the display panel 100. The gate driver 230 applies a gate-on voltage VON to a selected gate line and thus activates the selected gate line, and the data driver 220 outputs grayscale voltage to pixels that are connected with the activated gate line. Accordingly, the display panel 100 may display an image by a unit of a horizontal line (e.g., by a unit of a row). According to various embodiments of the present disclosure, the display device 1000 may include the gate driver 230 so as to be arranged at the display driving circuit 200. However, various embodiments of the present disclosure are not limited thereto. For example, if the display panel 100 is formed of a low temperature poly silicon (LTPS) material, the gate driver 230 may be directly arranged at the display panel 100.

The voltage generator 240 generates voltages that are used by the display driving circuit 200 and the display panel 100. The voltage generator 240 may generate a gate-on voltage VON, a gate-off voltage VOFF, a common voltage VCOM, and/or the like, in response to the control signal CNT3.

The gate driver 230 generates a gate signal that is applied to the gate lines GL1 through GLn, by using the gate-on voltage VON and the gate-off voltage VOFF. The common voltage VCOM is commonly provided to pixels PX of the display panel 100. As illustrated in FIG. 2, the common voltage VCOM may be provided to terminals of the liquid crystal capacitor Clc and the storage capacitor Cst.

The clock generating circuit 270 may generate and provide an internal clock signal ICLK to the timing controller 210. According to an operation mode, the timing controller 210 may generate timing signals, in response to the internal clock signal ICLK.

The host controller 300 controls all operations of the display driving circuit 200. For example, if the display device 1000 is a portable terminal such as a smartphone, a tablet PC, or the like, the host controller 300 may be an application processor.

The host controller 300 may communicate with the timing controller 210, may transmit the image data R, G, B and a signal such as the control signal CNT and the mode selection signal PSR including the horizontal synchronization signal, the vertical synchronization signal, a clock signal, a voltage setting signal, and/or the like for controlling the display driving circuit 200, and may receive a signal (e.g., a tearing signal TE), related to status information about the display driving circuit 200.

In order to decrease current consumption, the display device 1000 may vary a refresh rate (e.g., a frame frequency of the display panel 100), according to an operation mode. For example, the display device 1000 may vary the frame frequency, according to an operation mode such as a still image mode, a moving image mode, or the like. According to various embodiments of the present disclosure, the still image mode or the moving image mode may be determined in response to the mode selection signal PSR that is provided from the host controller 300. The host controller 300 may analyze whether the image data R, G, B provided to the display driving circuit 200 is a still image or a moving image, and as a result of the analysis when the image data R, G, B is a moving image, the host controller 300 may provide, as the mode selection signal PSR, a first operation mode signal indicating the moving image mode to the display driving circuit 200, and when the image data R, G, B is a still image, the host controller 300 may provide, as the mode selection signal PSR, a second operation mode signal indicating the still image mode to the display driving circuit 200. This is referred as a panel self refresh (PSR) function, and detailed descriptions thereof will be described in detail with reference to FIG. 4.

The display device 1000 operates at a frame frequency of at least about 60 Hz so as to prevent the occurrence of flicker of an image. However, according to various embodiments of the present disclosure, the display device 1000 may the frame frequency during the moving image mode at a relatively high value, and may set the frame frequency during the still image mode at a relatively low value. Afterward, a gamma curve is set according to the set frame frequency, so that, although the frame frequency is low (e.g., when the operation mode is the still image mode), the occurrence of flicker may be prevented. The frame frequency may be set as a first frame frequency of at least about 60 Hz during the moving image mode, and the frame frequency may be set as a second frame frequency of at least about 50 Hz during the still image mode. However, the frame frequency is not limited thereto. The frame frequency may vary according to a characteristic of the display panel 100.

In order to set the gamma curve according to the frame frequency, the timing controller 210 may output one of a first gamma selection signal GMS1 corresponding to the first frame frequency and a second gamma selection signal GMS2 corresponding to the second frame frequency, as a gamma control signal GMCS. Accordingly, during the moving image mode, the frame frequency is set as the first frame frequency and the gamma curve is set based on the first gamma selection signal GMS1. In contrast, during the still image mode, the frame frequency is set as the second frame frequency and the gamma curve is set based on the second gamma selection signal GMS2.

According to various embodiments of the present disclosure, during a power-on or initial setting of the display device 1000, the first gamma selection signal GMS1 and the second gamma selection signal GMS2 may be stored in the storage unit 260 of the timing controller 210 and may be selectively used according to an operation mode thereafter. The storage unit 260 may be formed as a register, a non-volatile memory, and/or the like. A value of the first gamma selection signal GMS1, which corresponds to the still image mode, may vary in response to the control signal CNT from the host controller 300.

The display device 1000 may adjust a falling slew rate of a gate signal that is provided to the gate lines GL1 through GLn, according to the frame frequency, and thus may decrease the occurrence of flicker. As described with reference to FIG. 2, when the kickback voltage is generated, flicker may occur, and as the kickback voltage is increased, the visibility of flicker is also increased. In addition, the falling slew rate of the gate signal is high, the kickback voltage may be great. Thus, the timing controller 210 may set a kickback signal KB when the display panel 100 is driven based on the second frame frequency, and the voltage generator 240 may generate the gate-on voltage VON that periodically falls in response to the kickback signal KB, so that the falling slew rate of the gate signal may be decreased. To do so, the voltage generator 240 may include a kickback compensating circuit (not shown). This will be described in detail with reference to FIGS. 9 and 10.

As described above, the display device 1000 may vary the frame frequency according to an operation mode, may set the gamma curve that corresponds to the frame frequency, may adjust the falling slew rate of the gate signal, and thus may operate with low power without deterioration in an image quality.

Figure 3A:
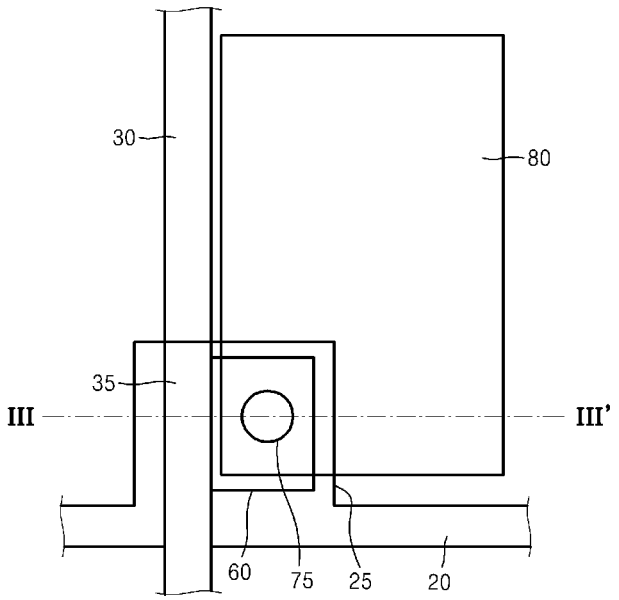
FIGS. 3A and 3B are a plan view and a cross-sectional view of an oxide thin film transistor that is applied to a pixel of a display panel such as, for example, the display panel illustrated in FIG. 1 according to an embodiment of the present disclosure.
Figure 3B:
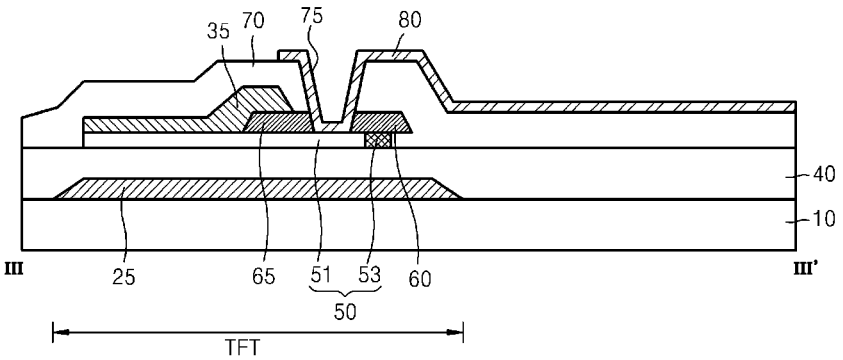

FIGS. 3A and 3B are a plan view and a cross-sectional view of an oxide thin film transistor TFT that is applied to a pixel of a display panel such as, for example, the display panel illustrated in FIG. 1 according to an embodiment of the present disclosure.

As described above with reference to FIG. 2, the pixel PX includes the thin film transistor TFT. A channel layer of the thin film transistor TFT may be formed as an amorphous silicon layer, an oxide semiconductor layer, or the like. The oxide semiconductor layer may have higher mobility than mobility of the amorphous silicon layer and may have a small leakage current. Thus, according to various embodiments of the present disclosure, in order to decrease occurrence of flicker while the display panel 100 is driven at a low frequency, the display panel 100 of the display device 1000 may be formed as an oxide thin film transistor substrate where each pixel PX includes an oxide thin film transistor.

Referring to FIGS. 3A and 3B, the oxide thin film transistor TFT (hereinafter, referred as the TFT) includes a gate electrode 25 that is connected with a gate line 20 and forms a gate pattern with the gate line 20, a gate insulating layer 40 that covers the gate pattern, an oxide layer 50 that is disposed on the gate insulating layer 40 and overlaps with the gate electrode 25, a first protective layer 60 that is disposed on the oxide layer 50, and a source electrode 35 that overlaps with a portion of the first protective layer 60 and is connected with a data line 30. The source electrode 35 may be formed as a separate pattern, or a portion of the data line 30 may function as a source electrode.

A second protective layer 70 is disposed on the TFT. A pixel electrode 80 is formed on the second protective layer 70 and thus contacts the oxide layer 50 via a first hole 65 formed in the first protective layer 60 and a second hole 75 formed in the second protective layer 70. The gate insulating layer 40 may have a single-layer structure including silicon oxide (SiOx) or a dual-layer structure including silicon nitride (SiNx) and silicon oxide (SiOx).

The first protective layer 60 functions as an etch stopper and protects a channel region of the oxide layer 50 when the source electrode 35 is patterned. The first protective layer 60 may formed as a silicon oxide (SiOx) layer. The second protective layer 70 may be formed as an insulating layer including silicon nitride (SiNx).

The oxide layer 50 may be formed of amorphous oxide including at least one of indium (In), zinc (Zn), gallium (Ga), and hafnium (Hf). The oxide layer 50 may be formed of Zn oxide or In—Zn composite oxides that further include Ga or Hf. In more detail, the amorphous oxide may be a Ga—In—Zn—O layer including $In_2O_3$—$Ga_2O_3$—ZnO or a Hf—In—Zn—O layer including $HfO_2$—$In_2O_3$—ZnO.

The oxide layer 50 includes a first region 51 having a semiconductor characteristic, and a second region 53 surrounding the first region 51 and having conductivity. The second region 53 is connected with the source electrode 35.

The second protective layer 70 may be deposited on the substrate 10 by chemical vapor deposition (CVD). In general, a gas including hydrogen is used as a reaction gas in a process according to which silicon nitride (SiNx) is deposited by CVD, and due to the hydrogen, a characteristic of a region of the oxide layer 50 that is adjacent to silicon nitride (SiNx) is changed and thus the region has conductivity. In contrast, a region of the oxide layer 50, which is not adjacent to the second protective layer 70, may maintain its semiconductor characteristic.

The first hole 65 and the second hole 75 may be formed with respect to portions of the first region 51. For example, the portions of the first region 51 are exposed by the first hole 65 and the second hole 75. Because the pixel electrode 80 contacts the first region 51 via the first hole 65 and the second hole 75, it is not required to form a separate pattern for a drain electrode. Thus, the second region 53 functions as a source electrode, a portion of the first region 51, which contacts the pixel electrode 80, functions as a drain electrode, and another portion of the first region 51, which does not contact the pixel electrode 80, functions as a channel.

Thus, according to the TFT structure, a capacity of a parasitic capacitor (refer to the parasitic capacitor Cgd of FIG. 2) between a gate pattern and a drain electrode may be decreased. In addition, a length of a channel is decreased while a width of the channel is increased, so that a TFT ON current may be increased.

The oxide TFT that is applied to the display panel 100 of FIG. 1 is described above with reference to FIGS. 3A and 3B. However, various embodiments of the present disclosure are not limited thereto, and an oxide TFT having another structure, or different types of thin film transistor may be used.

Figure 4:
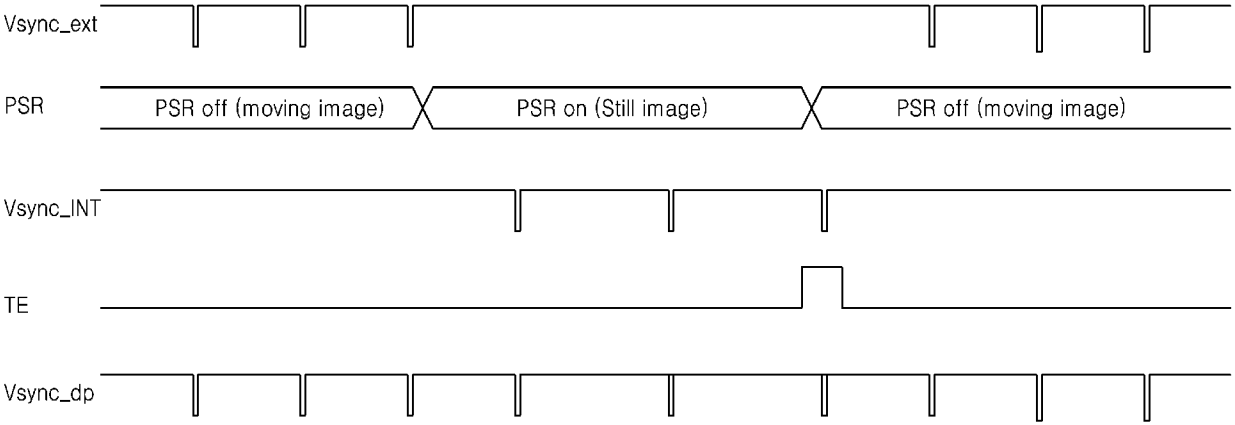
FIG. 4 is a timing diagram related to a panel self refresh (PSR) function that is applied to a display device such as, for example, the display device illustrated in FIG. 1 according to an embodiment of the present disclosure.

FIG. 4 is a timing diagram related to a PSR function that is applied to a display device such as, for example, the display device illustrated in FIG. 1 according to an embodiment of the present disclosure.

As described above with reference to FIG. 1, the display device 1000 may vary a frame frequency according to an operation mode. The operation mode may be one of a moving image mode and a still image mode, according to whether the image data R, G, B provided to the display driving circuit 200 is a moving image or a still image.

When the display device 1000 displays a moving image (e.g., only when the display device 1000 operates during the moving image mode, in order to reduce system load and current consumption of the host controller 300), the host controller 300 periodically transmits the image data R, G, B and the control signal CNT such as the horizontal synchronization signal, the vertical synchronization signal, or the clock signal. In contrast, when the display device 1000 displays a still image, the host controller 300 may transmit image data R, G, B of one frame to the display driving circuit 200 and may cut a serial interface. The display driving circuit 200 may store the image data R, G, B of one frame in the frame memory 250 (refer to FIG. 1) and may refresh the display panel 100 with the image data R, G, B. This is referred as the PSR function.

The host controller 300 may provide a mode selection signal PSR indicating a first mode selection signal PSR off or a second mode selection signal PSR on to the timing controller 210 of the display driving circuit 200, wherein the first mode selection signal PSR off indicates transmission of the moving image and OFF of the PSR function, and the second mode selection signal PSR on indicates transmission of the still image and ON of the PSR function.

Referring to FIG. 4, when the timing controller 210 receives the first mode selection signal PSR off, the timing controller 210 may generate a screen synchronization signal Vsync_dp, in response to a horizontal synchronization signal Vsync_ext (hereinafter, referred as the external horizontal synchronization signal Vsync_ext) and a clock signal that are provided from the host controller 300. In contrast, when the timing controller 210 receives the second mode selection signal PSR on, the timing controller 210 may generate a horizontal synchronization signal Vsync_INT (hereinafter, referred as the internal horizontal synchronization signal Vsync_INT) in response to an internal clock signal ICLK that is generated by the clock generating circuit 270 and may generate a screen synchronization signal Vsync_dp in response to the internal horizontal synchronization signal Vsync_INT. A frequency of the internal horizontal synchronization signal Vsync_INT is set less than the external horizontal synchronization signal Vsync_ext, so that the frame frequency may be decreased.

When the still image mode (e.g., PSR on) is switched to the moving image mode (e.g., PSR off), in order to prevent an image tearing problem due to a difference in frame frequencies, the timing controller 210 may transmit, to the host controller 300, a tearing signal TE that indicates a status of ready to receive and display a moving image, and the host controller 300 may receive the tearing signal TE and then may transmit image data R, G, B of the moving image and a control signal CNT such as the external horizontal synchronization signal Vsync_ext or a clock signal to the display driving circuit 200.

Figure 5A:
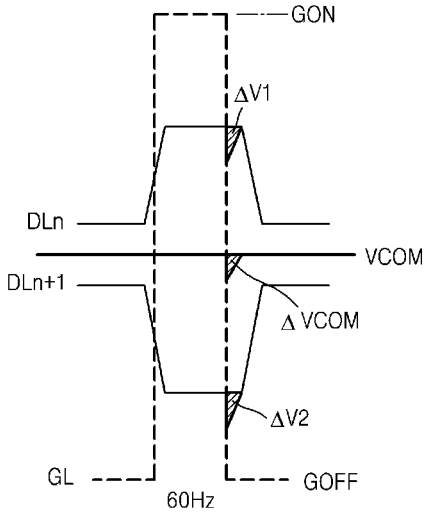
FIGS. 5A and 5B are diagrams related to kickback voltages according to frame frequencies according to an embodiment of the present disclosure.
Figure 5B:
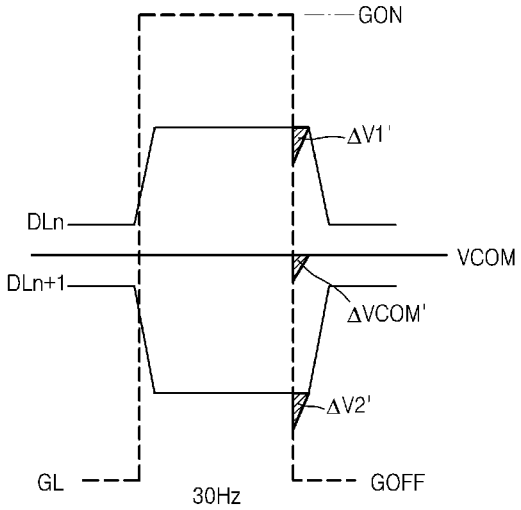

FIGS. 5A and 5B are diagrams related to kickback voltages according to frame frequencies according to an embodiment of the present disclosure. For example, FIGS. 5A and 5B illustrate gate signals of gate lines GL, signals of data lines DLn and DLn+1, and common voltages VCOM that are related to kickback voltages according to frame frequencies according to an embodiment of the present disclosure. FIG. 5A illustrates a case according to which the frame frequency is 60 Hz according to an embodiment of the present disclosure, and FIG. 5B illustrates a case according to which the frame frequency is 30 Hz according to an embodiment of the present disclosure.

Referring to FIGS. 5A and 5B, when the gate signal that is applied to the gate line GL is switched from a gate-on voltage VON to a gate-off voltage VOFF, kickback voltages $\Delta V1$ and $\Delta V2$ are generated due to the parasitic capacitor Cgd between the gate electrode and the source electrode of the thin film transistor TFT (refer to FIG. 2.) The kickback voltage $\Delta V1$ of the data line DLn to which a positive grayscale voltage is applied is different from the kickback voltage $\Delta V2$ of the data line DLn+1 to which a negative grayscale voltage is applied. In addition, variation $\Delta VCOM$ of the common voltage VCOM differs according to polarities, such that flicker occurs. In addition, as illustrated in FIGS. 5A and 5B, when the frame frequencies are different, a time of applying a grayscale voltage via the data lines DLn and DLn+1 also varies, so that the amount of charges that are charged in the liquid crystal capacitor Clc and the storage capacitor Cst of the pixel PX (refer to FIG. 2) varies, and thus variations of kickback voltages and common voltages differ in the case according to which the frame frequency is 60 Hz and the case according to which the frame frequency is 30 Hz (e.g., $\Delta V1 \neq \Delta V1'$, $\Delta V2 \neq \Delta V2'$, $\Delta VCOM \neq \Delta VCOM'$). Thus, in order to prevent the flicker, a gamma curve and the common voltage VCOM may be set in consideration of a kickback voltage and may vary according to the frame frequencies.

Figure 6:
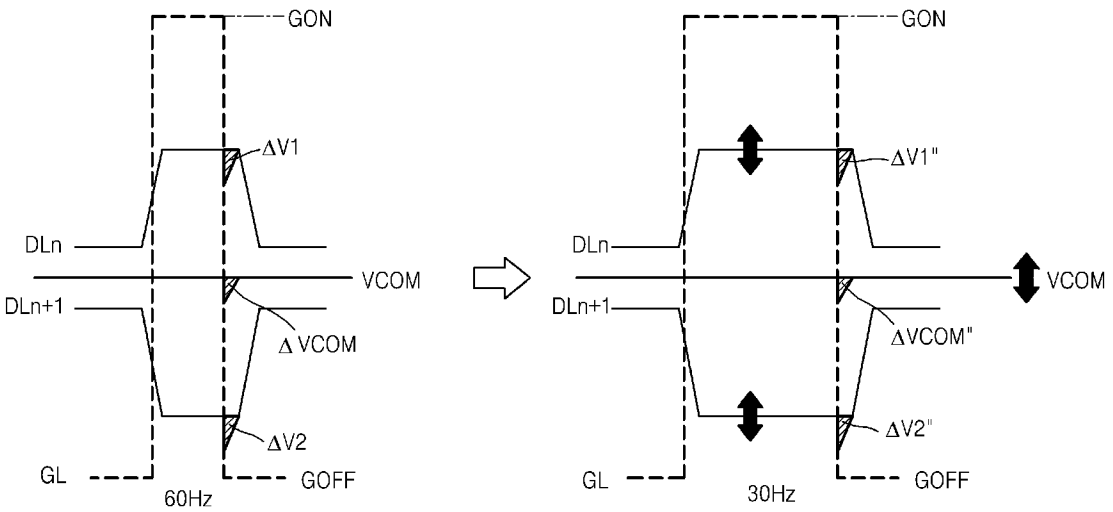
FIG. 6 illustrates an example according to which a gamma curve and a common voltage vary according to frame frequencies according to an embodiment of the present disclosure.

FIG. 6 illustrates an example according to which a gamma curve and a common voltage VCOM vary according to frame frequencies according to an embodiment of the present disclosure.

According to various embodiments of the present disclosure, the display device 1000 (refer to FIG. 1) may variously set the gamma curve and the common voltage VCOM according to the frame frequencies. Referring to FIG. 6, when a frame frequency is changed from 60 Hz to 30 Hz, the display device 1000 may adjust a level of the common voltage VCOM and the gamma curve. Thus, although the frame frequency is decreased to 30 Hz, kickback voltages $\Delta V1''$ and $\Delta V2''$ and a variation $\Delta VCOM''$ of the common voltage VCOM are adjusted so as to be similar to voltages $\Delta V1$ and $\Delta V2$ and the variation $\Delta VCOM$ of the common voltage VCOM when the frame frequency is 60 Hz, so that occurrence of flicker may be prevented.

Figure 7:
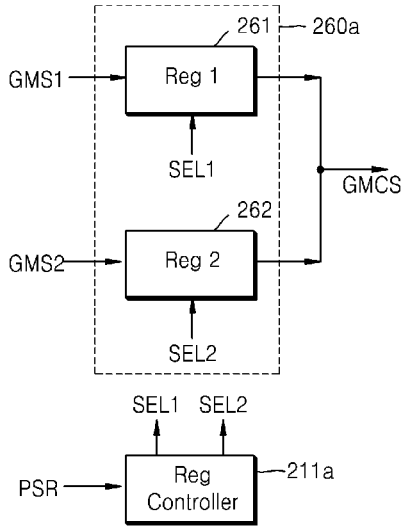
FIG. 7 is a block diagram of an example according to which a timing controller such as, for example, the timing controller illustrated in FIG. 1 selects a gamma control signal according to a driving mode according to an embodiment of the present disclosure.

FIG. 7 is a block diagram of an example according to which a timing controller such as, for example, the timing controller illustrated in FIG. 1 selects a gamma control signal according to a driving mode according to an embodiment of the present disclosure.

Referring to FIG. 7, a first gamma selection signal GMS1 and a second gamma selection signal GMS2 may be provided from an external source (e.g., a host controller such as the host controller 300 illustrated in FIG. 1) and may be respectively stored in a storage unit 260*a*. For example, the first gamma selection signal GMS1 and the second gamma selection signal GMS2 may be respectively stored in a first storage unit 261 and a second storage unit 262. The first gamma selection signal GMS1 is a signal for selecting a gamma curve that corresponds to a first frame frequency, and the second gamma selection signal GMS2 is a signal for selecting a gamma curve that corresponds to a second frame frequency that is lower than the first frame frequency. During a power-on or initial setting of the display device 1000, the first gamma selection signal GMS1 and the second gamma selection signal GMS2 may be provided from the host controller 300 and may be respectively stored in the first storage unit 261 and the second storage unit 262. The first storage unit 261 and the second storage unit 262 may be formed as registers, one time programmable (OTP) memories, non-volatile memories, and/or the like.

The first storage unit 261 and the second storage unit 262 may output the first gamma selection signal GMS1 and the second gamma selection signal GMS2, in response to first and second selection signals SEL1 and SEL2, respectively. The first and second selection signals SEL1 and SEL2 may be generated by a controller 211*a*, in response to an operation mode signal PSR. The first and second selection signals SEL1 and SEL2 may be complementary signals. As illustrated in FIG. 7, the first selection signal SEL1 and the second selection signal SEL2 are indicated as separate signals. However, various embodiments of the present disclosure are not limited thereto. Thus, the first selection signal SEL1 and the second selection signal SEL2 may be one signal that differs in signal levels.

Referring to FIG. 7, if the operation mode signal PSR indicates a moving image mode, then the first gamma selection signal GMS1 may be output as a gamma control signal GMCS in response to the first selection signal SEL1, and if the operation mode signal PSR indicates a still image mode, then the second gamma selection signal GMS2 may be output as the gamma control signal GMCS in response to the second selection signal SEL2.

Referring to FIG. 7, two gamma selection signals (e.g., the first and second gamma selection signal GMS1 and GMS2) that correspond to the first and second frame frequencies are stored. However, various embodiments of the present disclosure are not limited thereto. The display device 1000 may drive the display panel 100 based on one of at least three frame frequencies, according to an operation mode and a frequency of the internal clock signal ICLK based on setting of the clock generating circuit 270 (refer to FIG. 1), thus, at least three gamma selection signals may be set in correspondence to the at least three frame frequencies.

Figure 8:
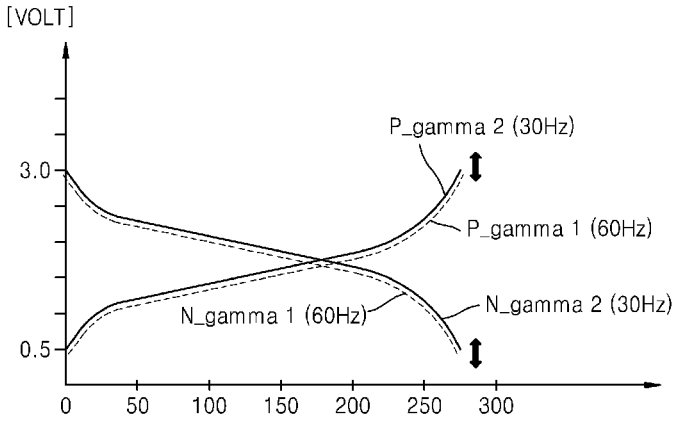
FIG. 8 is a graph of gamma curves with respect to frame frequencies according to an embodiment of the present disclosure.

FIG. 8 is a graph of gamma curves with respect to frame frequencies according to an embodiment of the present disclosure.

Referring to FIG. 8, the gamma curves may be variously set according to the frame frequencies. For example, a grayscale voltage according to first gamma curves P_gamma 1 and N_gamma 1 and a grayscale voltage according to second gamma curves P_gamma 2 and N_gamma 2 differ. Referring to FIG. 8, the grayscale voltage according to the second gamma curves P_gamma 2 and N_gamma 2 is higher than the grayscale voltage according to the first gamma curves P_gamma 1 and N_gamma 1. However, various embodiments of the present disclosure are not limited thereto. A grayscale voltage according to a gamma curve may variously set according to characteristics of the display panel 100 (refer to FIG. 1).

Figure 9:
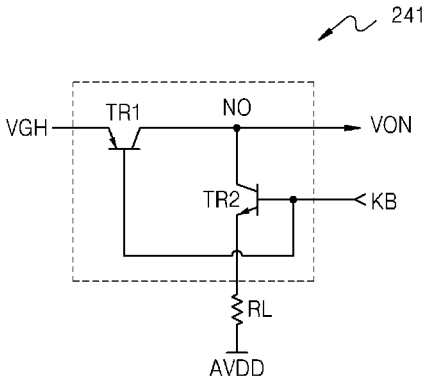
FIG. 9 illustrates a kickback compensating circuit in a voltage generator such as, for example the voltage generator illustrated in FIG. 1 according to an embodiment of the present disclosure.
Figure 10:
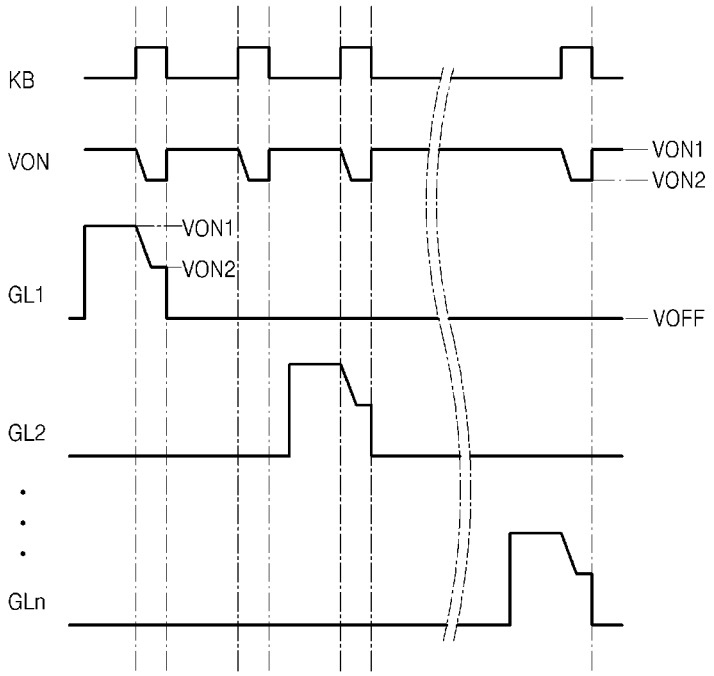
FIG. 10 illustrates waveforms of signals according to an operation of the kickback compensating circuit according to an embodiment of the present disclosure.

FIG. 9 illustrates a kickback compensating circuit in a voltage generator such as, for example, the voltage generator 240 of FIG. 1 according to an embodiment of the present disclosure. FIG. 10 illustrates waveforms of signals according to an operation of the kickback compensating circuit according to an embodiment of the present disclosure.

As illustrated in FIGS. 5A and 5B, a kickback voltage that causes flicker is generated when a voltage level of a gate signal is switched from a gate-on voltage VON to a gate-off voltage VOFF and increase in proportion to a difference between the gate-on voltage VON and the gate-off voltage VOFF. Thus, the display device 1000 may decrease the kickback voltage by adjusting a falling slew rate of the gate signal.

To do so, the voltage generator 240 of FIG. 1 may include the kickback compensating circuit 241 of FIG. 9.

Referring to FIG. 9, the kickback compensating circuit 241 may include a first transistor TR1, a second transistor TR2, and a load resistor RL. The first transistor TR1 may receive a gate high voltage VGH and may transmit the gate high voltage VGH to an output terminal NO, in response to a kickback signal KB.

Referring to FIG. 10, a signal level of the kickback signal KB may be periodically changed. The gate high voltage VGH may be generated by the voltage generator 240 and may indicate a first voltage level VON1 of FIG. 10. The second transistor TR2 and the load resistor RL are serially connected between the output terminal NO and an analog power voltage source AVDD, and the second transistor TR2 discharges charges from the output terminal NO with the analog power voltage AVDD, in response to the kickback signal KB. Accordingly, as illustrated in FIG. 10, a level of a gate-on voltage VON that is output from the output terminal NO is periodically decreased from the first voltage level VON1 to a second voltage level VON2 that is lower than the first voltage level VON1, in response to the kickback signal KB.

Referring to FIG. 9, the first and second transistors TR1 and TR2 are bipolar junction transistors. However, various embodiments of the present disclosure are not limited thereto. The first and second transistors TR1 and TR2 may be formed as metal oxide silicon field effect (MOS) transistors.

Referring to FIG. 10, the gate-on voltage VON is periodically decreased, so that levels of gate signals that are provided to gate lines GL1 through GLn are switched from the gate-on voltage VON having the first voltage level VON1 to the gate-on voltage VON having the second voltage level VON2 that is lower than the first voltage level VON1, and then the levels of the gate signals are switched to a gate-off voltage VOFF, thus, the falling slew rate of the gate signal may be decreased.

Figure 11:
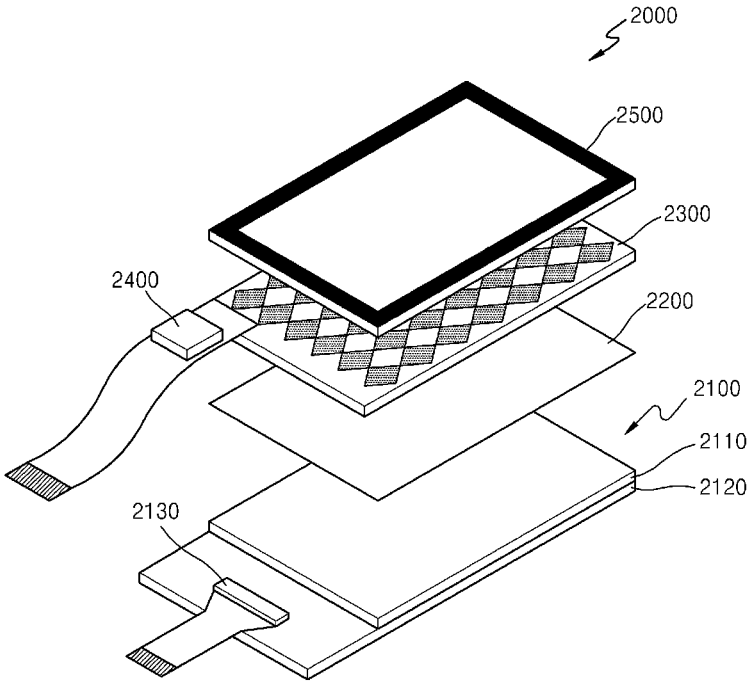
FIG. 11 illustrates a display module according to an embodiment of the present disclosure.

FIG. 11 illustrates a display module 2000 according to an embodiment of the present disclosure.

Referring to FIG. 11, the display module 2000 may include a display device 2100, a polarizing plate 2200, and a window glass 2500. The display device 2100 includes a display panel 2110, a printed circuit board 2120, and a display driving chip 2130.

The window glass 2500 is generally formed of acryl or tempered glass and protects the display module 2000 against external shock or scratches due to a touch. The polarizing plate 2200 may be arranged to improve an optical characteristic of the display panel 2110. The display panel 2110 is formed in a manner that a transparent electrode is patterned on the printed circuit board 2120. The display panel 2110 includes a plurality of pixel cells so as to display a frame. According to various embodiments of the present disclosure, the display panel 2110 may be an OLED panel. Each of the pixel cells includes an OLED that emits light in correspondence to flow of current. However, various embodiments of the present disclosure are not limited thereto and thus the display panel 2110 may include various types of display devices. For example, the display panel 2110 may be one of an LCD, an electrochromic display (ECD), a digital mirror device (DMD), an actuated mirror device (AMD), a grating light value (GLV), a plasma display panel (PDP), an electro luminescent display (ELD), a light-emitting diode (LED) display, a vacuum fluorescent display (VFD), and/or the like.

The display driving chip 2130 may include the display driving circuit 200 of FIG. 1. According to various embodiments of the present disclosure, the display driving chip 2130 is arranged as one chip. However, various embodiments of the present disclosure are not limited thereto, and a plurality of driving chips may be implemented as the display driving chip 2130. In addition, the display driving chip 2130 may be implemented in the form of a chip-on-glass (COG) on the printed circuit board 2120 that is formed of glass material. However, various embodiments of the present disclosure are not limited thereto, and the display driving chip 2130 may be implemented in the form of a chip-on-film (COF), a chip-on-board (COB), and/or the like.

The display module 2000 may further include a touch panel 2300 and a touch controller 2400. The touch panel 2300 is formed in a manner that a transparent electrode such as Indium Tin Oxide (ITO) is patterned on a glass substrate or a Polyethylene Terephthalate (PET) film. The touch controller 2400 detects an input of a touch on the touch panel 2300, calculates coordinates of the touch, and then transmits the coordinates of the touch to a host (not shown). The touch controller 2400 and the display driving chip 2130 may be integrated into one semiconductor chip.

The display module 2000 may be used in various electronic devices that display an image. For example, the display module 2000 may be used in not only portable terminals including a smartphone, a tablet PC, an e-book, a PMP, a navigation device, or the like but may also be broadly used in a TV, an automated teller machine (ATM) that automatically performs cash deposits and withdrawals at a bank, an elevator, a ticket issuing machine in a subway station, and/or the like.

Figure 12:
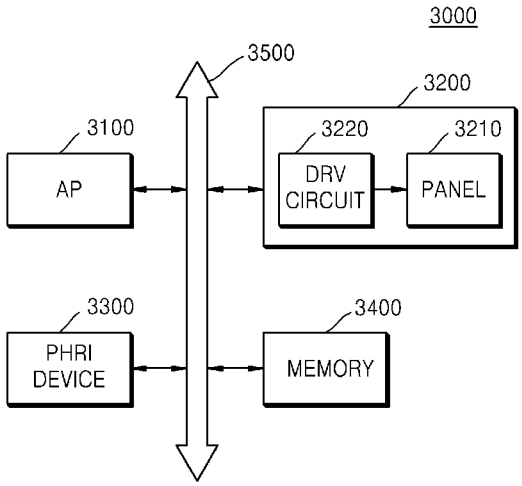
FIG. 12 illustrates a display system, according to an embodiment of the present disclosure.

FIG. 12 illustrates a display system according to an embodiment of the present disclosure.

Referring to FIG. 12, the display system 3000 may include an application processor (AP) 3100, a display device 3200, a peripheral device 3300, and a memory 3400 that are electrically connected with a system bus 3500.

The AP 3100 may control input and output of data of the peripheral device 3300, the memory 3400, and the display device 3200, and may perform image processing on image data exchanged between these elements.

The display device 3200 includes a display panel 3210 and a driving circuit 3220. The display device 3200 stores a plurality of pieces of image data, which are applied via the system bus 3500, in a frame memory (not shown) included in the driving circuit 3220, and displays the image data on the display panel 3210. The display device 3200 may correspond to the display device 1000 of FIG. 1. Thus, the display device 3200 may vary a frame frequency according to an operation mode and may selectively operate based on a low frame frequency, so that the display device 3200 may reduce power consumption and may prevent the occurrence of flicker.

The peripheral device 3300 may be a device such as a camera, a scanner, a web cam, and/or the like, that convert a moving image or a still image into an electrical signal. Image data obtained via the peripheral device 3300 may be stored in the memory 3400 or may be displayed in real-time on a panel of the display device 3200.

The memory 3400 may include a volatile memory device such as dynamic random access memory (DRAM) and/or a non-volatile memory device such as a flash memory. The memory 3400 may be DRAM, phase-change memory (PRAM), magnetoresistive RAM (MRAM), a resistive RAM (ReRAM), ferroelectric RAM (FRAM), a NOR flash memory, a NAND flash memory, a fusion flash memory (e.g., a memory where an SRAM buffer, a NAND flash memory, and a NOR interface logic are combined), and/or the like. The memory 3400 may store the image data obtained from the peripheral device 3300 or may store an image signal processed by the AP 3100.

The display system 3000 may be implemented as a mobile electronic product such as a smartphone. However, use of the display system 3000 is not limited thereto and may be implemented as various electronic products that display an image.

Figure 13:
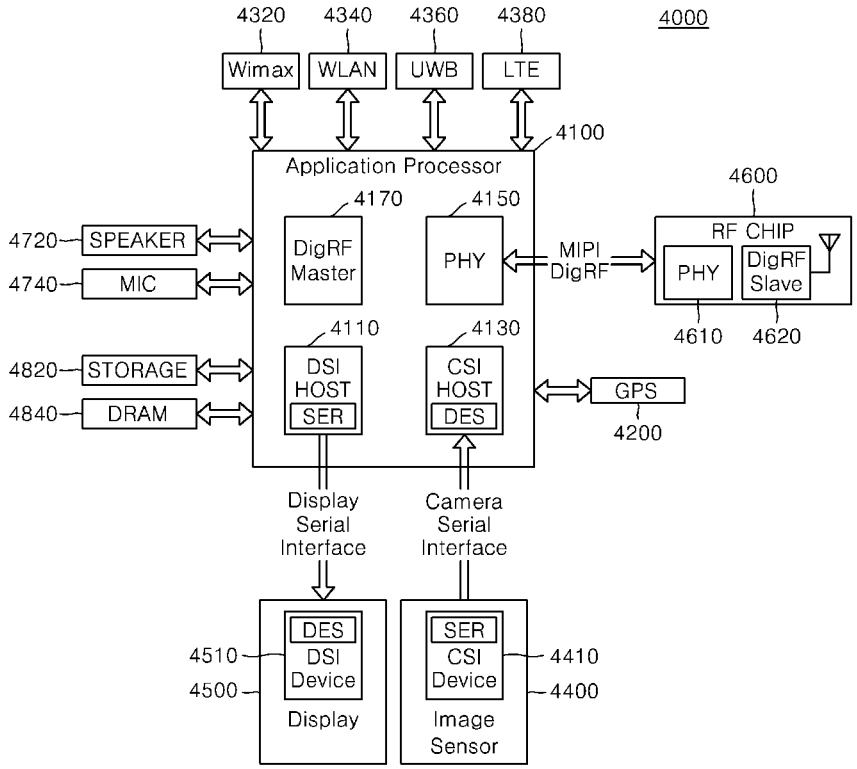
FIG. 13 illustrates an interface, and an electronic system including a display device, according to an embodiment of the present disclosure.

FIG. 13 illustrates an interface, and an electronic system including a display device according to an embodiment of the present disclosure.

Referring to FIG. 13, the electronic system 4000 may include a data processing device (e.g., a mobile phone, a PDA, a PMP, a smartphone that may use or support an MIPI interface, and/or the like). The electronic system 4000 may include an application processor 4100, an image sensor 4400, and the display device 4500.

A camera serial interface (CSI) host 4130 included in the application processor 4100 may perform serial communication with a CSI device 4410 of the image sensor 4400 via a CSI. In this regard, the CSI host 4130 may include an optical deserializer, and the CSI device 4410 may include an optical serializer.

A display serial interface (DSI) host 4110 included in the application processor 4100 may perform serial communication with a DSI device 4510 of the display device 4500 via a DSI. The DSI may be one of serial interfaces including MIPI®, MDDI, DisplayPort, I2C interface, eDP, or the like. According to various embodiments of the present disclosure, the display device 4500 may correspond to the display device 1000 of FIG. 1, and the DSI device 4510 may be a semiconductor chip in which the display driving circuit 200 of FIG. 1 is integrated. The DSI host 4110 may include an optical serializer, and the DSI device 4510 may include an optical deserializer.

The electronic system 4000 may further include a radio frequency (RF) chip 4600 capable of communicating with the application processor 4100. A PHY 4150 of the application processor 4100 and a PHY 4610 of the RF chip 4600 may exchange data according to the MIPI DigRF standard. The application processor 4100 may further include a DigRF Master 4170 that controls the data communications of the PHY 4150, and the RF chip 4600 may further include a DigRF Slave 4620 controlled by the DigRF Master 4170.

The electronic system 4000 may further include a global positioning system (GPS) 4200, a storage 4820, DRAM 4840, a speaker 4720, and a microphone 4740 and may communicate with an external device by using a communication protocol (or a communication standard), such as, for example, worldwide interoperability for microwave access (WiMAX) 4320, wireless local area network (WLAN) 4340, ultra-wideband (UWB) 4360, long term evolution (LTE) TM 4380, and/or the like. The electronic system 4000 may communicate with an external device by using Bluetooth, WiFi, Near Field Communication, and/or the like.

As described above, according to one or more embodiments of the present disclosure, in the display driving circuit, the display device, and the portable terminal including the display driving circuit and the display device, a kickback voltage that is one of the reasons that cause flicker may be decreased and a gamma characteristic that corresponds to a frame frequency may be provided, so that the flicker may not occur while the portable terminal is driven at a low frequency.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A display device comprising:

a display panel comprising:

a plurality of pixels, and a plurality of data lines and a plurality of gate lines that are respectively connected with the plurality of pixels; and a display driving circuit configured to:

set a frame frequency corresponding to the display panel according to an operation mode, select a gamma curve corresponding to the frame frequency from among a plurality of gamma curves that are set so as to correspond to different frame frequencies, and drive the display panel based on the selected gamma curve and the frame frequency, wherein the display driving circuit drops a level of a gate-on voltage from a first voltage level to a second voltage level according to a kickback signal to adjust a falling slew rate of a gate signal.

2. The display device of claim 1, wherein the display driving circuit is further configured to:

store a first gamma selection signal and a second gamma selection signal that correspond to different gamma curves, respectively, and select one of the first gamma selection signal and the second gamma selection signal as a gamma control signal, according to the frame frequency.

3. The display device of claim 1, wherein the plurality of gamma curves comprises:

a first gamma curve that corresponds to a first frame frequency, and a second gamma curve that corresponds to a second frame frequency that is lower than the first frame frequency, and wherein grayscale voltages of the second gamma curve are lower than grayscale voltages of the first gamma curve.

4. The display device of claim 1, wherein, during a moving image mode, the display driving circuit displays a moving image received from an external source on the display panel, based on a first frame frequency, and wherein, during a still image mode, the display driving circuit displays a still image stored in an internal frame memory on the display panel, based on a second frame frequency that is lower than the first frame frequency.

5. The display device of claim 4, wherein, during the moving image mode, the display driving circuit generates a display synchronization signal having the first frame frequency, based on a control signal and an external clock signal that are provided from the external source, and wherein, during the still image mode, the display driving circuit generates a display synchronization signal having the second frame frequency, based on an internal clock signal.

6. The display device of claim 1, wherein the display driving circuit is configured to adjust the falling slew rate of a gate signal that is provided to each of the plurality of gate lines, according to the frame frequency.

7. The display device of claim 6, wherein the display driving circuit is configured to generate the gate signal by using the gate-on voltage and a gate-off voltage, and wherein, when the frame frequency is equal to or lower than a reference value, the display driving circuit periodically drops the level of the gate-on voltage.

8. The display device of claim 1, further comprising:

a host controller configured to provide image data and an operation mode signal for indicating the operation mode to the display driving circuit.

9. The display device of claim 8, wherein, when the image data is a moving image, the host controller provides a first operation mode signal indicating a moving image mode to the display driving circuit, and wherein, when the image data is a still image, the host controller provides a second operation mode signal indicating a still image mode to the display driving circuit.

10. The display device of claim 8, wherein, during a power-on or initial setting of the display device, the host controller provides a plurality of gamma selection signals that correspond to the plurality of gamma curves, respectively, to the display driving circuit.

11. The display device of claim 1, wherein the display panel comprises an oxide thin film transistor substrate in which each of the plurality of pixels comprises an oxide thin film transistor.

* * * * *